US007478488B1

(12) United States Patent
Davis et al.

(10) Patent No.: US 7,478,488 B1
(45) Date of Patent: Jan. 20, 2009

(54) INFLATABLE AND VENTILATING UPPER FOR AN ARTICLE OF FOOTWEAR

(75) Inventors: Paul Davis, Blackstone, MA (US); Brian Christensen, Centerville, MA (US); Paul Litchfield, Westboro, MA (US)

(73) Assignee: Reebok International Ltd., Canton, MA (US)

( * ) Notice: Subject to any disclaimer, the term of this patent is extended or adjusted under 35 U.S.C. 154(b) by 372 days.

(21) Appl. No.: 11/262,481

(22) Filed: Oct. 31, 2005

(51) Int. Cl.
*A43B 13/20* (2006.01)

(52) U.S. Cl. ..... 36/29; 36/3 A

(58) Field of Classification Search ..... 36/29, 36/3 A, 3 B, 3 R, 153
See application file for complete search history.

(56) References Cited

U.S. PATENT DOCUMENTS

| | | | |
|---|---|---|---|
| 4,991,317 | A | 2/1991 | Lakic |
| 5,025,575 | A | 6/1991 | Lakic |
| 5,113,599 | A | 5/1992 | Cohen et al. |
| 5,144,708 | A | 9/1992 | Pekar |
| 5,158,767 | A | 10/1992 | Cohen et al. |
| 5,343,638 | A | 9/1994 | Legassie et al. |
| 5,351,710 | A | 10/1994 | Phillips |
| 5,406,661 | A | 4/1995 | Pekar |
| 5,435,230 | A | 7/1995 | Phillips |
| 5,590,696 | A | 1/1997 | Phillips et al. |
| 5,675,914 | A | 10/1997 | Cintron |
| 5,893,219 | A | 4/1999 | Smith et al. |
| 5,987,779 | A | 11/1999 | Litchfield et al. |
| 6,014,823 | A | 1/2000 | Lakic |
| 6,287,225 | B1 | 9/2001 | Touhey et al. |
| 6,557,274 | B2 | 5/2003 | Litchfield et al. |
| 6,785,985 | B2 | 9/2004 | Marvin et al. |
| 2004/0003517 | A1 | 1/2004 | Marvin et al. |
| 2005/0028404 | A1 | 2/2005 | Marvin et al. |
| 2005/0198858 | A1 | 9/2005 | Hsu |

OTHER PUBLICATIONS

Digital photographs of prototype insole and patent application entitled "Inflatable Shoe Sole" describing the prototype (date, inventor and applicant unknown—not apparent if application was ever filed in China or English speaking country).

*Primary Examiner*—Ted Kavanaugh
(74) *Attorney, Agent, or Firm*—Sterne, Kessler, Goldstein & Fox P.L.L.C.

(57) ABSTRACT

An article of footwear includes a sole, an upper attached to the sole, where the upper includes an fluid system structure including an inflatable bladder and a ventilation system, and an inflation mechanism fluidly connected to at least one of the inflatable bladder and the ventilation system.

14 Claims, 5 Drawing Sheets

INFLATABLE AND VENTILATING UPPER FOR AN ARTICLE OF FOOTWEAR

FIELD OF THE INVENTION

The present invention relates generally to an article of footwear having an upper which inflates and ventilates.

BACKGROUND OF THE INVENTION

Fit, cushioning and shock absorption are challenges facing footwear designers. Inflatable articles have been used in the upper, under the foot, or within the sole of a shoe to enhance a shoe's fit, to provide cushioning and to help absorb shock while standing, walking or running. Inflatable products are particularly desirable for footwear because they are lightweight and can be adjustable to accommodate the particular cushioning, support or fit desired by the wearer.

Some inflatable bladders are inflated at the factory, while others have valves fluidly connected to inflation mechanisms, such that the individual wearer may adjust the pressure of the air, or other fluid, within the inflatable bladder. An on-board inflation mechanism, i.e., an inflation mechanism incorporated directly into or onto a shoe, is particularly convenient and allows the wearer to change the pressure within the inflatable bladder without having to carry around a removable inflation mechanism.

Such on-board inflation mechanisms may be accessible to the wearer from the exterior of the shoe, such that the wearer can manually actuate the inflation mechanism when a pressure increase in the shoe is desired. Alternatively, such an on-board inflation mechanism may be positioned beneath a wearer's foot, so that the downward pressure from the foot with each step automatically actuates the inflation mechanism.

Inflatable bladders are typically made of a fluid-tight material such as various thermoplastic materials. However, since air and perspiration do not flow readily through these materials, a wearer's foot may become warm and clammy, creating an excellent environment for harmful bacteria growth. It is therefore desirable to keep a foot cool and dry while in such a shoe.

For example, U.S. Patent Application Publication No. 2004/0003517 discloses a bladder with generally diamond shaped openings therein. The openings are generally made where interior weld lines welding thermoplastic sheets together are formed in a closed diamond shape and the material inside of interior weld line is removed forming an opening. The openings, or windows are particularly useful for allowing air to be accessible to the foot and for allowing moisture to be drawn away from the foot, since synthetic material, such as polyurethane films, may cause the foot to generate moisture in the shoe.

Further, several shoes that automatically try to move air to and from an interior of a shoe have been developed. However, these shoes generally require complex tubing or complex sole designs in order to draw air from one area of the shoe and deliver it to another.

BRIEF SUMMARY OF THE INVENTION

The present invention provides a simple and easily manufactured fluid system that includes both an inflatable bladder and a ventilating system in the upper.

In one embodiment, an article of footwear includes a sole, an upper attached to the sole including a fluid system structure including an inflatable bladder and a ventilation system, and an inflation mechanism fluidly connected to at least one of the inflatable bladder and the ventilation system.

In another embodiment of the present invention, an article of footwear, includes a sole, an upper attached to the sole having an inflatable bladder formed from a first sheet and a second sheet of a thermoplastic material and a ventilation system formed from the second sheet and a third sheet of a thermoplastic material. The ventilation system is disposed closer to an interior space defined by the upper than the inflatable bladder. The article of footwear also includes a first inflation mechanism fluidly connected to the inflatable bladder and a second inflation mechanism fluidly connected to the ventilation system. The first and second inflation mechanisms are operated by the downward pressure of a wearer's foot and are disposed one on top of another.

In another embodiment of the present invention, an article of footwear, includes a sole and an upper attached to said sole. The upper having an inflatable bladder and a ventilation system formed from two sheets of thermoplastic material sealed together along a peripheral weld line. The inflatable bladder and the ventilation system are separately defined by interior weld lines, and the ventilation system includes a plurality of perforations in one of the two sheets of thermoplastic material. The article of footwear also includes an inflation mechanism operated by the downward pressure of a wearer's foot. The inflation mechanism includes a fluid inlet and a first fluid outlet fluidly connected to the inflatable bladder with a first valve allowing fluid to flow from the inflation mechanism to the inflatable bladder and restricting fluid from flowing from the inflatable bladder to the inflation mechanism. The inflation mechanism also includes a second fluid outlet fluidly connected to the ventilation mechanism with a second valve allowing fluid to flow from the inflation mechanism to the ventilation system and restricting fluid from flowing from the ventilation system to the inflation mechanism. The first valve is actuated at a lower pressure than the second valve.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

The present invention will be described with reference to the accompanying drawings. The drawing in which an element first appears is typically indicated by the leftmost digit (s) in the corresponding reference number.

DETAILED DESCRIPTION OF THE INVENTION

The present invention is directed to a fluid system formed in the upper of a shoe having both an inflatable bladder and a ventilation system, preferably formed as a unitary structure for ease of manufacture.

Figure 1:
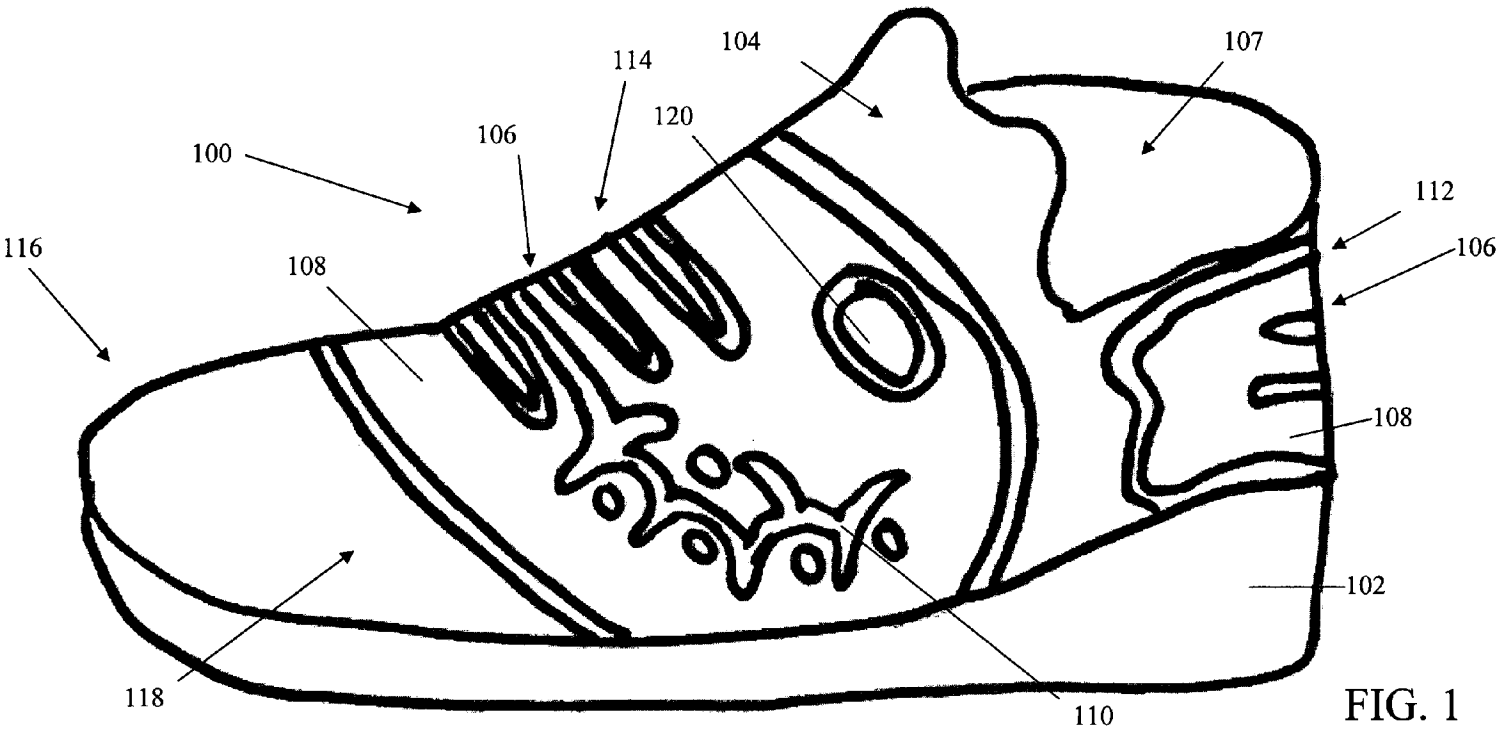
FIG. 1 is a lateral side view of an embodiment of the present invention.

FIG. 1 illustrates an article of footwear, or shoe, 100 having a sole 102 and an upper 104 attached to sole 102. FIG. 1 is a left shoe, where a right shoe would be a mirror image of shoe 100. Upper 104 includes a fluid system 106 and defines an opening therein 107 for insertion of a wearer's foot. Fluid system 106, which is further illustrated in FIG. 2, includes an inflatable bladder 108 and an ventilation system 110. Article of footwear 100 generally includes a heel portion 112, a vamp portion 114 and a toe portion 116, a lateral side 118 and a medial side (not shown). An optional deflation mechanism 120 is also illustrated in FIG. 1 positioned on lateral side 118 of article of footwear 100. A medial side of shoe 100 would be similar to the lateral side illustrated in FIG. 1 but including the medial portions of fluid system 106 discussed below with respect to FIG. 2.

Figure 2:
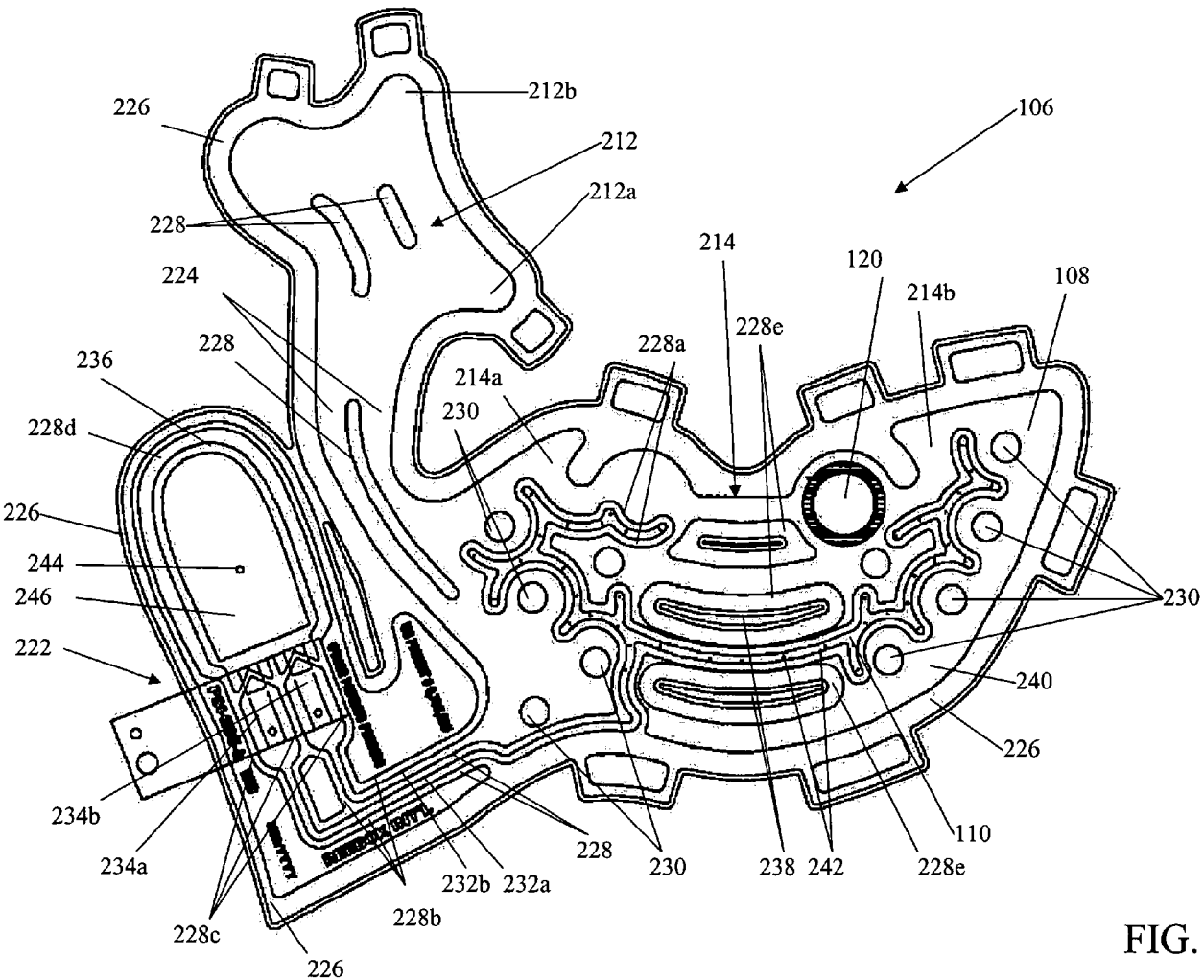
FIG. 2 is schematic plan view of a fluid system of the present invention.

Also included in article of footwear 100 is at least one inflation mechanism 222, which is illustrated as being formed monolithically with fluid system 106 in FIG. 2. In the embodiment of FIG. 2, fluid system 106 includes an enlarged heel portion 212, including a medial heel portion 212*a* and a lateral heel portion 212*b*, a vamp portion 214, including a medial vamp portion 214*a* and a lateral vamp portion 214*b*. Medial vamp portion 214*a* is fluidly connected to medial heel portion 212*a* by channels 224 extending along medial side (not shown) of article of footwear 100. One skilled in the art, however can appreciate that a fluid system 106 of the present invention may have an alternative configuration, shape or design.

Fluid system 106 may be defined by, for example, an exterior layer or film and a coextensive interior layer or film. The fluid system may be shaped in a variety of configuration, such as that shown for fluid system 106 in FIG. 2. Thermoplastic films can be formed from a variety of thermoplastic resins or other elastomeric materials, including, but not limited to, polyurethanes (TPU), ethylenevinylacetate/polyethylene copolymer; polyester elastomer (Hytrel); ethylenevinylacetate/polypropylene copolymer; polyethylene; polypropylene; neoprene; natural rubber; dacron/polyester; polyvinylchloride; thermoplastic rubbers; nitrile rubber; butyl rubber; sulfide rubber; polyvinyl acetate; methyl rubber; buna N.; buna S.; polystyrene; ethylene propylene; polybutadiene; polypropylene; silicone rubber, chlorsulfonated polyethylene, nylon, metallized polyester, such as MYLAR® (available from Dupont Teijin Films, Wilmington, Del.), and other thermoplastic or elastomeric materials. One particular example is a polyester urethane film having a 85A shore hardness and a melting temperature of 150° C., available from Hyo-Sung Corp. (Korea). The interior layer and the exterior layer may also be formed from different materials. The interior layer is attached to the exterior layer along air-tight peripheral weld lines 226. The peripheral weld lines 226 attach the exterior layer to the interior layer and create a barrier to keep air or other fluid between the layers. Forming a monolithic fluid system that includes an inflatable bladder 108 and a ventilation system 110 in the upper of a shoe streamlines manufacturing processes and better utilizes space within an article of footwear. Additionally, a monolithic arrangement of a fluid system 106 as illustrated in FIG. 2 allows both cushioning and ventilation to access a larger area of a wearer's foot within the shoe. Further, the inflatable bladder provides custom fit for the wearer in that an inflatable bladder will conform to the wearer's foot.

One example of a suitable method of attachment of the exterior layer to the interior layer is the application of high radio frequency energy (RF welding) to the edges of the first and second film. The exterior and interior layers may alternatively be heat welded or ultrasonic welded together or attached by any other air tight means. Interior weld lines 228 are also provided. These interior weld lines 228 are also formed by RF welding, heat welding, ultrasonic welding, by the methods discussed elsewhere herein, or by other suitable means, and form the inflatable bladder 108 and ventilation system 110 of the present invention, which are discussed in detail below. Circular weld lines 230 may also be provided throughout inflatable bladder 108. A higher concentration of circular weld lines 230 along with interior weld lines 228 control the thickness of inflatable bladder 108 in these areas, since bladder cannot expand as thick in narrower channels. Although circular weld lines 230 are illustrated as being circular, they may be formed in a parallelogram, oval, an irregular shape or any other configuration as may be suitable in a particular application or as a may be particularly preferred for aesthetic or functional reasons.

Where the exterior layer and interior layer are only attached along the peripheral weld lines 226 and the interior weld lines 228, an inflatable bladder 108 is formed which allows a fluid, such as air, another gas or a liquid, to be introduced between the exterior layer and the interior layer. Interior weld lines 228*a* define ventilation system 110. Interior weld lines 228*b* define passageway 232*a* from inflation mechanism 222 to ventilation system 110 and passageway 232*b* from inflation mechanism 222 to inflatable bladder 108. Interior weld lines 228*c* define portions of one-way valves 234*a* and 234*b*. Interior weld line 228*d* defines an inflation chamber 236 of inflation mechanism 222. Providing an inflation mechanism 222 monolithically formed along with the fluid system further reduces manufacturing procedures and creates a more lightweight shoe with less parts and less expense.

FIG. 2 illustrates a plan view of an interior surface 240 of a fluid system 106. Ventilation system 110 includes a plurality of holes 242 on interior surface 240. Holes 242 allow air in the fluid system 106 to escape into the interior of the shoe to cool and dry the wearer's foot. In another embodiment, an exterior surface (not shown, but which would appear substantially as a mirror image of interior surface 240 of FIG. 2) may or may not have holes 242 similarly located therein or may have holes 242 instead of interior surface 240. This is particularly useful if additional material or padding defines an exterior surface of article of footwear 100. As such, the air escaping from the external surface of fluid system 106 will access the interior of article of footwear 100. In yet another embodiment, discussed in further detail below with respect to inflation mechanism 222, holes 242 may also be used as an inlet for air within article of foot wear 100 to enter fluid system 106. In this embodiment, warm, moist air surrounding the wearer's foot is pulled away from the foot into the ventilation system 110, thus cooling and drying the wearer's foot.

Additionally, interior weld lines 228*e* may be formed in a closed shape, for example the elliptical shape illustrated in FIG. 2, and the material inside of closed interior weld line 228*e* removed, forming an opening 238. Openings 238 are useful for cooling and drying the foot when synthetic materials or other external material layer of a shoe upper cause the foot to generate moisture inside the shoe.

The exterior and interior thermoplastic films or sheets are welded together along all the weld lines discussed above and then die cut to form the predetermined shape of fluid system 106. Alternatively, fluid system 106 may be formed by blow molding, extrusion, injection molding and sealing, vacuum forming or any other thermoforming or sealing process using a thermoplastic material. For example, fluid system 106 may be made by heat sealing around a printed barrier pattern, such as that described in U.S. patent application Ser. No. 11/171,475, which is incorporated herein by reference in its entirety.

Fluid system 106 may form at least a portion of an exterior and/or an interior surface of upper 104, for example, a bladder of the present invention may also be formed with a layer of external material bonded or laminated to one or both of the exterior and interior layers. The bonding can occur either before or after the formation of fluid system 106. One suitable material is LYCRA® (available from DuPont). LYCRA® is a flexible and breathable material. Alternatively, one or both of the exterior and interior layers may be bonded to a foam laminate, any type of synthetic material, or any other material that would be available to one skilled in the art, or that is typically used in the production of a shoe.

Fluid system 106 is fluidly connected to an inflation mechanism. As will be described with reference to FIGS. 2-5, a portion of fluid system 106 can be isolated to form an inflation mechanism 222. Inflation mechanism 222 fluidly communicates with the remainder of the fluid system 106 via first and second one-way valves 234*a* and 234*b*. One-way valves 234*a* and 234*b* allow the isolated portion of the fluid system 106 to act as an inflation mechanism. Having an inflation mechanism formed as an isolated portion of the fluid system is preferably suitable for an underfoot bladder so as to automatically inflate the bladder as a user engages in activity, such as walking, jogging or running.

Any type of one-way valve is suitable for use in conjunction with inflation mechanism 222 of the present invention. Preferably, the valve will be relatively small and flat for less bulkiness. U.S. Pat. No. 5,144,708 to Pekar, incorporated herein by reference in its entirety, describes a valve suitable for the present invention. The patent describes a valve formed between thermoplastic sheets. The valve described in the Pekar patent allows for simple construction techniques to be used whereby the valve can be built into the system at the same time the bladder is being welded. Another one-way valve may be an umbrella valve such as those described in U.S. patent application Ser. No. 11/250,613, filed Oct. 17, 2005, which is incorporated herein by reference in its entirety. One skilled in the art would understand that a variety of suitable valves are contemplated in the present invention, and the present invention is not limited to use of any particular one-way valve.

Inflation mechanism 222 in FIG. 2 includes an inflation chamber 236 defined by an interior weld line 228*d*. In an alternative embodiment, inflation chamber 236 may be defined by peripheral weld line 226. Similarly channels 232*a* and 232*b* and one-way valves 234*a* and 234*b* may be partially defined by peripheral weld line 226, rather than interior weld lines 228*b* and 228*c*, respectively.

In the embodiment of FIG. 2, inflation chamber 236 includes an inlet 244. In FIG. 2 inlet 244 is merely a hole, or opening, in one of the first and second sheets of thermoplastic material that define fluid system 106. With each step that is taken, the hole is sealed shut and the air located in inflation chamber 236 is forced through one-way valves 234*a* and 234*b* into fluid system 106. The downward pressure from the wearer's foot against the hole creates a substantially air tight seal. Alternatively, the wearer's foot may place pressure on another sole component such as a sockliner or lasting board, which in-turn places pressure against inflation chamber 236 to block inlet 244. One-way valves 234*a* and 234*b* will allow fluid to flow only into fluid system 106. As the gait cycle continues, the wearer's foot rises releasing the pressure on inflation chamber 236 and removing the seal covering the inlet 244. Air, preferably from inside the shoe or alternatively from a tube directed outside of the shoe, is forced through inlet 244 to equalize the pressure in inflation chamber 236. Consequently, a inflating mechanism is created that consistently provides air to fluid system 106 with each step. Alternatively, a one-way valve may be used at inlet 244 instead of a hole. As such, inlet 244 may be located anywhere fluidly connected to inflation chamber 236. The one-way valve (not shown) will allow air to flow from the environment into inflation chamber 236, but will limit the flow of air from inflation chamber 236 to the environment. As such, when pressure is released from inflation chamber 236, air will be drawn into inflation chamber 236 through the one-way valve.

Inflation chamber 236 preferably include a collapsible foam core 246. Foam core 246 assists in expanding the volume of the inflation chamber 236, allowing air to enter with the expansion of inflation chamber 236. Further, other under foot pumps, such as satellite inflation mechanisms or inflation mechanisms with a moisture and other environmental condition barriers, such as those described in U.S. Patent Application Publication No 2005/0028404, which is incorporated herein by reference in its entirety, may alternatively be incorporated into the present invention. One skilled in the art can appreciate that other types of inflation mechanisms, for example motorized, electronic or any other mechanical inflation mechanism, may be suitable for an inflation mechanism of the present invention.

As illustrated in FIG. 2, first one-way valve 234*a* is fluidly connected to ventilation system 110 via first channel 232*a*. Similarly, second one-way valve 234*b* is fluidly connected to inflatable bladder 108 via second channel 232*b*. In one embodiment, second one-way valve 234*b* is less resistant to air flow than first one-way valve 234*a*. As such, when a wearer places pressure on inflation mechanism 222, air in inflation chamber 236 will be directed first into inflatable bladder 108, since less pressure will be required to overcome second one-way valve 234*b* than first one-way valve 234*a*. As the pressure in inflatable bladder 108 reaches a state about equal to the air pressure exerted by inflation chamber 236 through second one-way valve 234*b*, air will be diverted instead through first one-way valve 234*a*. With a continuous cycle of downward pressure on inflation chamber 236, for example by walking, the bladder 108 inflates to provide cushioning and fit to the wearer's foot, and once it reaches a certain pressure within inflation mechanism 108, air diverts into ventilation system to cool and dry the wearer's foot.

In an alternative embodiment, second one-way valve 234*b* may be a regulating valve, such that when the pressure within bladder 108 reaches a predetermined pressure air will cease flowing into bladder 108 and be instead diverted to ventilation system 110 through first one-way valve 234*a*. The diverted air enters ventilation system 110 and exits through holes 242 in ventilation system. In yet another embodiment, first one-way valve 234*a* and second one-way valve 234*b* may be replaced with a pressure sensitive diverter valve. As such, when air pressure within inflatable bladder 108 reaches a predetermined pressure, air from inflation mechanism 236 is diverted into ventilation system 110. The predetermined pressure in these alternative embodiments may be adjustable by the wearer and/or may be less than a pressure exerted by inflation chamber 236 in order to control the inflation of bladder 108.

Further, fluid system 106 may include a deflation mechanism 120. For example, it may be desirable to open a valve to remove air inflatable bladder 108 to provide space for the shoe to be removed from the wearer's foot. Thus, one embodiment of a deflation mechanism 120 includes a release valve can be opened and closed by the wearer to release pressurized air within bladder 108. Examples of such a on/off, or open/closed, release valve may be found in U.S. Patent Application Publication No. 2005/0028404, which is incorporated herein by reference in its entirety.

As an alternative deflation mechanism 120, a manually operated release valve may be fluidly connected to bladder 108. The release valve can comprise any type of release valve. One type of release valve is the plunger-type described in U.S. Pat. No. 5,987,779, which is incorporated herein by reference in its entirety, wherein the air is released upon depression of a plunger which pushes a seal away from the wall of the bladder allowing air to escape. In particular, a release valve may have a spring which biases a plunger in a closed position. A flange around the peripheral of the plunger can keep air from escaping between the plunger and a release fitting because the flange is biased in the closed position and in contact with the release fitting. To release air from bladder 108, the plunger is depressed by the user. Air then escapes around the stem of the plunger. This type of release valve is mechanically simple and light weight. The components of a release valve may be made out of a number of different materials including plastic or metal. Any release valve is appropriate for use in any embodiment of the present invention.

FIG. 1 shows one possible location of deflation mechanism 120 on shoe 100. However deflation mechanism 120 may be positioned in any number of different locations provided that it is fluidly connected with bladder 108, as would be apparent to one skilled in the relevant art. Additionally, shoe 100 may include more than one deflation valve.

As an alternative, deflation mechanism 120 may be a check valve, or blow off valve, which will open when the pressure in bladder 108 is at or greater than a predetermined level. In each of these situations, bladder 108 will not inflate over a certain amount no matter how much a user attempts to inflate the shoe. One type of check valve has a spring holding a movable seating member against an opening in the bladder. When the pressure from the air inside the bladder causes a greater pressure on the movable seating member in one direction than the spring causes in the other direction, the movable seating member moves away from the opening allowing air to escape the bladder. Another type of check valve is an umbrella valve, such as the VA-3497 Umbrella Check Valve (Part No. VL1682-104) made of Silicone VL1001M12 and commercially available from Vernay Laboratories, Inc. (Yellow Springs, Ohio, USA). In addition, any other check valve is appropriate for use in the present invention, as would be apparent to one skilled in the art. Further, any check valve would be appropriate for use in any of embodiments of the present invention.

In another embodiment, deflation mechanism 120 may be an adjustable check valve wherein a user can adjust the pressure at which the check valve is released. An adjustable check valve has the added benefit of being set to an individually preferred pressure rather than a factory predetermined pressure. For example, an adjustable check valve may be similar to the spring and movable seating member configuration described in the preceding paragraph. To make it adjustable, however, the valve may have a mechanism for increasing or decreasing the tension in the spring, such that more or less air pressure, respectively, would be required to overcome the force of the spring and move the movable seating member away from the opening in the bladder. However, any type of adjustable check valve is appropriate for use in the present invention, as would be apparent to one skilled in the art, and any adjustable check valve would be appropriate for use in any embodiment of the present invention.

Bladder 108 may include more than one type of deflation mechanism 120. For example, bladder 108 may include both a check valve and a release valve. Alternatively, bladder 108 may contain a deflation mechanism 120 which is a combination release valve and check valve. Any of the features of release valve and check valve, such as a release valve that turns on/off and/or a check valve which is adjustable, may further be incorporated into a combination check valve and release valve, for example those discussed in detail in U.S. Patent Application Publication No. 2005/0028404, which is incorporated herein by reference in its entirety.

In another embodiment, small perforations may be formed in inflatable bladder 108 to allow air to naturally diffuse through the bladder when a predetermined pressure is reached. The material used to make inflatable bladder 108 may be of a flexible material such that these perforations will generally remain closed. If the pressure in inflatable bladder 108 becomes greater than a predetermined pressure, the force on the sides of inflatable bladder 108 will open the perforation and air will escape. When the pressure in bladder 108 is less than this predetermined pressure, air will escape very slowly, if at all, from these perforations. Any embodiment of a bladder of the present invention may also have these perforations for controlling the amount of air within the bladder.

In yet another embodiment (not shown), the direction of first one-way valve 232*a* may be reversed, such that ventilation system 110 functions as an inlet rather than hole 244 in inflation chamber 236. In this embodiment, downward pressure on inflation chamber 236 forces air only into inflatable bladder 108. As the pressure on inflation chamber 236 is released, rather than air entering through a hole or other inlet 244, first one-way valve 234*a* opens drawing air into inflation chamber 236 from ventilation system 110, and more importantly from the interior of the shoe through holes 242. Preferably, this embodiment incorporates a filter of some sort since moisture and dirt from the interior of a wearer's foot may cause one or more of first one way valve 234*a*, second one way valve 234*b* and inflation chamber 236 to operate improperly. In such an embodiment, any of the deflation mechanism 120 discussed above may be particularly suitable for use with the inflatable bladder 108 to control the pressure therein.

In another embodiment, the fluid system 106 illustrated in FIG. 2 may be used to form at least a portion of an exterior surface of a shoe, such as shoe 100 in FIG. 1. In this embodiment, holes 242 may be provided on the exterior surface of the upper. As such, air from the interior of the shoe enters inflation mechanism 222 via inlet 244 to inflate inflatable bladder 108. Once inflatable bladder 108 is inflated, air flows into ventilation system 110. However, instead of recirculating air from within the shoe, the ventilation system 110 expels air to the exterior of the shoe. The removal of warm, humid air by this method is another way to effectively cool the foot.

Figure 3:
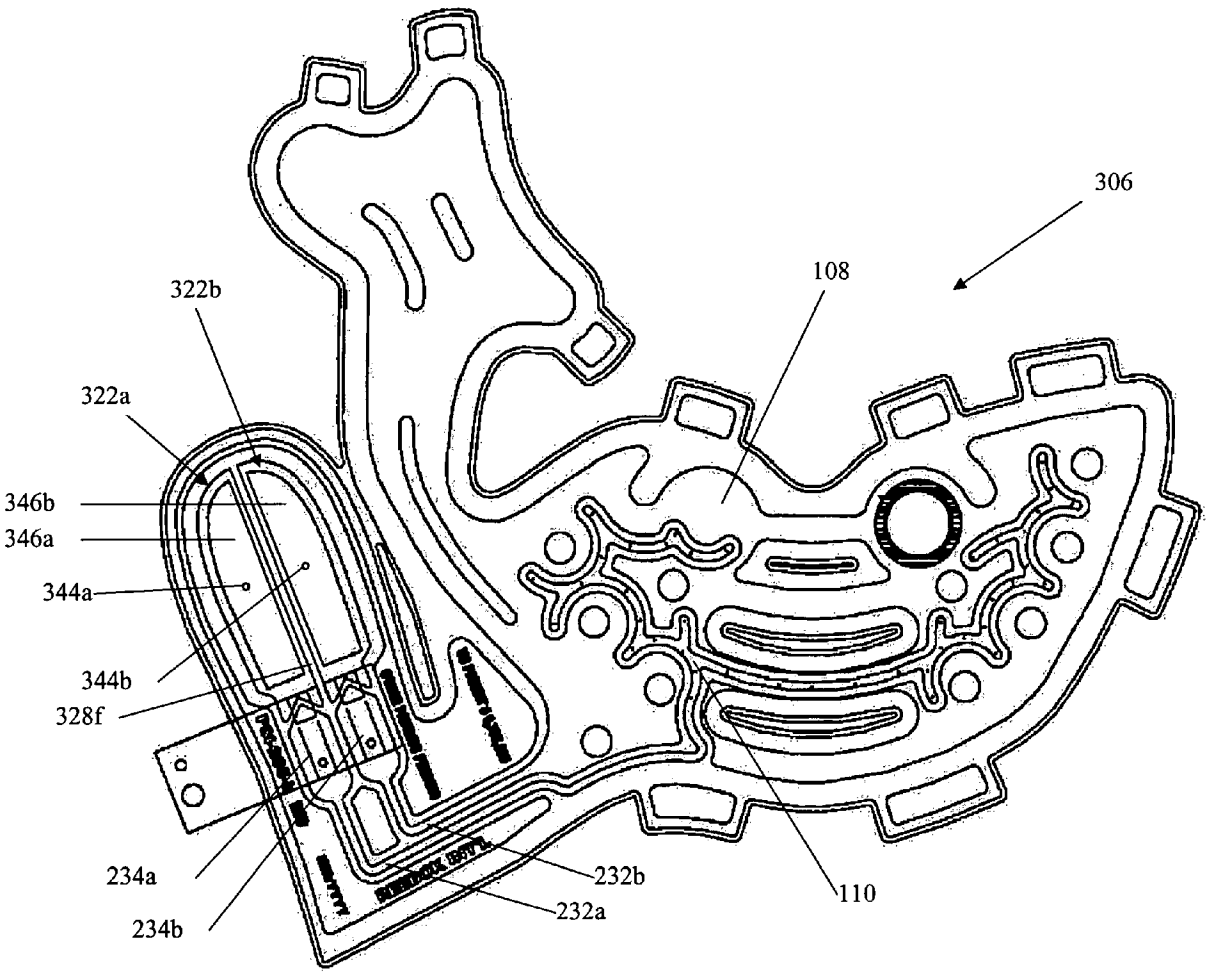
FIG. 3 is a schematic plan view of an alternative fluid system of the present invention.

In FIG. 2, one inflation mechanism 222 is used both to inflate inflatable bladder 108 and to provide air for ventilation system 110. However, as illustrated in FIG. 3, a first inflation mechanism 322*a* may be used to operate ventilation system 110 via first one-way check valve 234*a* and first channel 232*a* and a second inflation mechanism 322*b* may be used to inflate inflatable bladder 108 via second one-way check valve 234*b* and second channel 232*b*. In the embodiment of a fluid system 306 illustrated in FIG. 3, first and second inflation mechanism 322*a* and 322*b* may be positioned horizontally parallel, or side-by-side. In the embodiment of FIG. 3, an interior weld line 328*f* separates first inflation mechanism 322*a* and second inflation mechanism 322*b*. First inflation mechanism 322*a* includes a first foam core 346*a* and a first inlet 344*a*, and second inflation mechanism 322*b* includes a second foam core 346*b* and a second inlet 344*b*. Each of first and second inflation mechanisms 322*a* and 322*b* function, respectively, as described above with respect to inflation mechanism 222. Alternative embodiments may have first and second inflation mechanisms 322*a* and 322*b* shaped or configured differently so as to provide more or less volume thereto. In the embodiment of FIG. 3, or any embodiment which employs different inflation mechanism for inflatable bladder 108 and ventilation system 110, it may be particularly desirable to include one of the deflation mechanisms discussed above, particularly a check valve for controlling the continuous flow of air into inflatable bladder 108.

In yet another embodiment (not shown), a first and second inflation mechanism may be arranged vertically parallel, or one on top of the other, similar to that discussed below with respect to FIG. 5. Also in this embodiment, the same portion of a wearer's foot may be used to provide downward pressure on both first and second inflation mechanisms. More accurately, the wearer's foot, or another part of the shoe between the wearer's foot and the upper inflation mechanism, exerts downward pressure on the upper inflation mechanism, which in-turn exerts downward pressure on the lower inflation mechanism. Either the first or second inflation mechanism, i.e., either the inflation mechanism fluidly connected to the inflatable bladder 108 or the inflation mechanism fluidly connected to the ventilation system 110, may be the upper inflation mechanism, while the other is the lower inflation mechanism.

In yet further embodiments, one or both of first and second inflation mechanisms 322*a*/322*b*, may be operated by hand rather than automatically operated by the downward pressure of a wearer's foot. As such, the exact placement of inflation mechanisms 322*a* and 322*b* may be altered provided that they are fluidly communicating with ventilation system 110 and inflatable bladder 108, respectively. For example, first inflation mechanism 322*a* may be automatically operated by the downward pressure of a wearer's foot, since ventilation is desirable continuously, while second inflation mechanism 322*b* may be manual, since a level of comfort may be set once without constantly being adjusted. However, the opposite arrangement, i.e., first inflation mechanism 322*a* being manually operated and second inflation mechanism 322*b* being automatically operated by the downward pressure of a wearer's foot, or an alternative arrangement with both first and second inflation mechanism being manual, may be a more desirable arrangement in some situations, such as for controlled cooling or drying.

In such an arrangement, a variety of different manual inflation mechanisms may be utilized for inflation mechanism 322*b* in the present invention. Preferably, the inflation mechanism is small, lightweight, and provides a sufficient volume of air such that only little effort is needed for adequate inflation. Inflation mechanism 322*b* may be, for example, a simple latex bulb which is physically attached to the shoe. For example, U.S. Pat. No. 5,987,779, which is incorporated by reference herein in its entirety, describes an inflation mechanism comprising a bulb (of various shapes) with a one-way check valve. When the bulb is compressed, air within the bulb is forced into a desired location. As the bulb is released, the check valve opens because of the pressure void in the bulb, allowing ambient air to enter the bulb. Alternatively, the inflation mechanism 322*b* may be a molded plastic chamber or may be a hand held pump such as one which utilizes $CO_2$ gas to inflate a bladder.

Another inflation mechanism, also described in U.S. Pat. No. 5,987,779, incorporated by reference herein in its entirety, is a bulb having a hole which acts as a one-way valve. The wearer's finger can be placed over the hole in the bulb upon compression. Therefore, the air is not permitted to escape through the hole and is forced into a desired location. When the finger is removed, ambient air is allowed to enter through the hole. An inflation mechanism having collapsible walls in order to displace a greater volume of air may be preferred. A similar inflation mechanism may include a temporarily collapsible foam insert. This foam insert ensures that when the bulb is released, the bulb expands to the natural volume of the foam insert drawing in air to fill that volume.

U.S. Pat. No. 6,287,225, incorporated by reference herein in its entirety, describes another type of on-board inflation mechanism suitable for the present invention. One skilled in the art can appreciate that a variety of inflation mechanisms are suitable for the present invention. In addition, such inflation mechanisms are appropriate for use with any embodiment of the present invention.

Another inflation mechanism described in U.S. Patent Application Publication No. 2005/0028404, which is incorporated by reference in its entirety herein, is an accordion style inflation mechanism comprising a plastic, collapsible case. Air enters through a hole open to the exterior of the inflation mechanism. The inflation mechanism operates similar to that described above with respect to the bulb inflation mechanism except that the casing is collapsed in an accordion-style to increase the amount of air forced into the system. Upon release, the accordion-style casing expands and the air is forced into the casing to regulate the pressure within the casing.

Inflation mechanism 222 of FIG. 2 and inflation mechanisms 322*a* and 322*b* of FIG. 3 are positioned with respect to fluid systems 106 and 306, respectively, so as to be disposed under the heel of a wearer's foot. In an alternative embodiment, an inflation mechanism, or mechanisms, as in the case of FIG. 3, may be disposed elsewhere, for example, under the forefoot of the wearer, or on the upper. For example, with each step a wearer takes the top of the wearer's foot will flex against upper 104. As such, in one embodiment, the inflation mechanism may be positioned between the vamp portion 114 of upper 104 and the wearer's foot where the foot flexes. Thus, when a wearer flexes his foot air is forced into fluid system 106 via the inflation mechanism.

Figure 4:
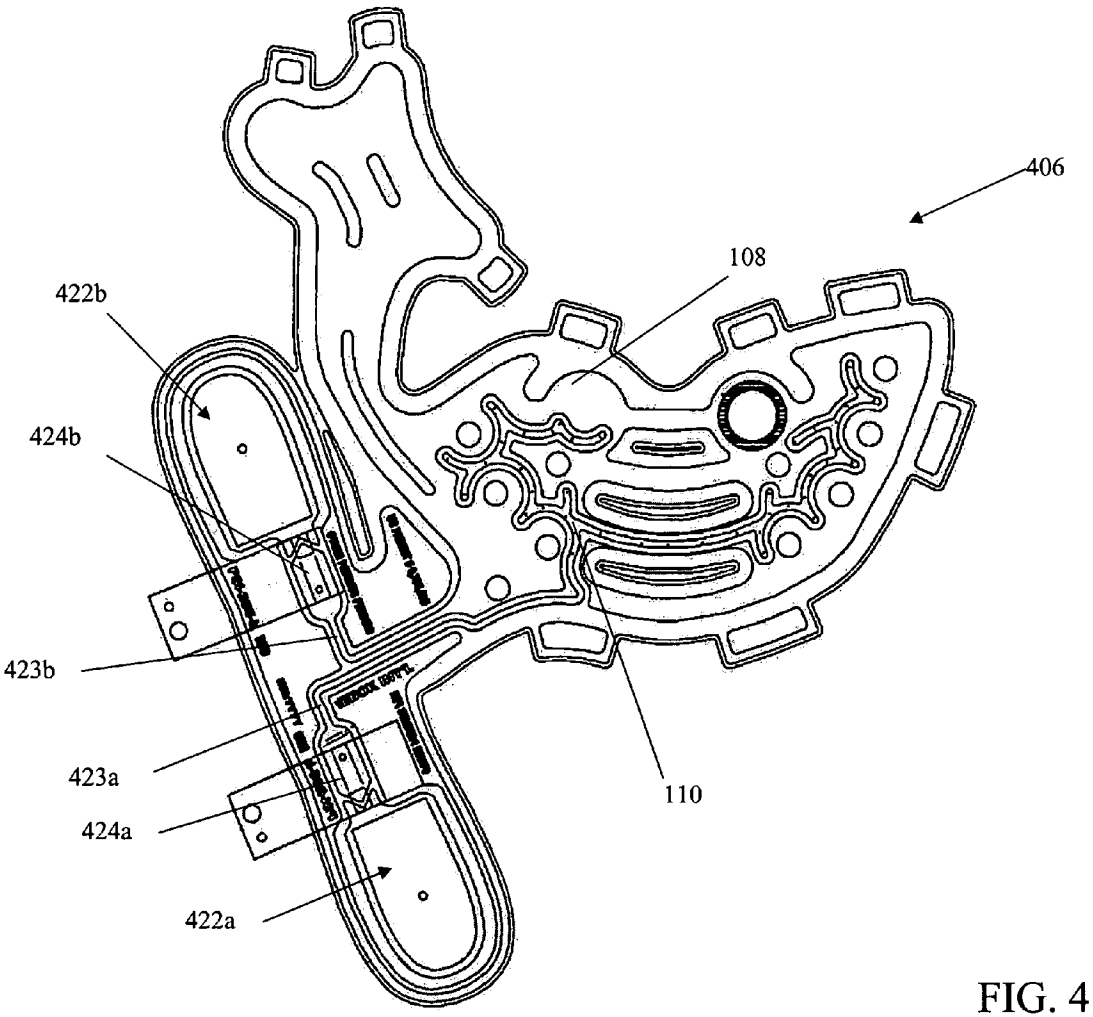
FIG. 4 is a schematic plan view of an alternative fluid system of the present invention.

FIG. 4 illustrates another position for first and second inflation mechanisms 422*a* and 422*b* and a fluid system 406. In this embodiment, first inflation mechanism 422*a*, which is fluidly connected to ventilation system 110 via first one-way valve 424*a* and first channel 423*a*, is disposed so as to be operated by the downward pressure of a wearer's forefoot. Meanwhile, second inflation mechanism 422*b*, which is fluidly connected to inflatable bladder 108 via second one-way valve 424*b* and second channel 423*b*, is disposed so as to be operated by the downward pressure of a wearer's heel. In an alternative embodiment, first inflation mechanism may be disposed so as to be operated by the downward pressure of a wearer's heel and second inflation mechanism may be disposed so as to operated by the downward pressure of a wearer's forefoot.

Figure 5:
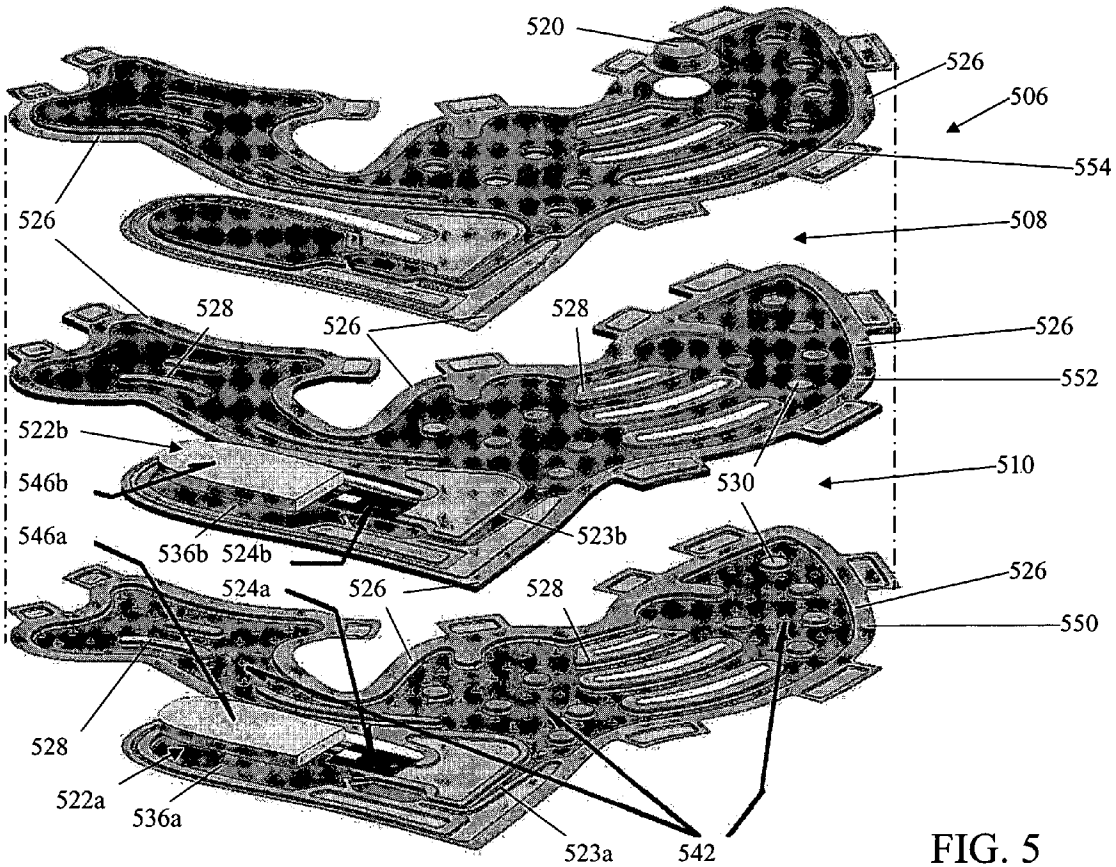
FIG. 5 is an exploded perspective view of an alternative fluid system of the present invention.

FIG. 5 illustrates a expanded view of a three-layered embodiment of a fluid system 506, including a first internal layer 550, a second intermediate layer 552, and a third external layer 554. First internal layer includes a plurality of perforations 542 through the surface of the layer. As such, first internal layer 550 and second intermediate layer 552 are sealed along a peripheral weld line 526, interior weld lines 528 and circular welds 530 to form ventilation system 510. Similarly, second intermediate layer 552 and third exterior layer 554 are sealed along peripheral weld line 526, interior weld lines 528 and circular welds 530 to form inflatable bladder 508.

A first inflation mechanism 522*a* is also formed where first interior layer 550 is sealed to second intermediate layer 552, and is fluidly connected to ventilation system 510 via a first one-way valve 524*a* and a first channel 524*a*. Likewise, a second inflation mechanism 522*b* is formed where second intermediate layer 552 is sealed to third exterior layer 554 and is fluidly connected to inflatable bladder 508 via a second one-way valve 524*b* and a second channel 523*b*. As such, first inflation mechanism 522*a* and second inflation mechanism 522*b* are vertically parallel, or one on top of the other. As discussed above, downward pressure by the wearer's foot will activate both first and second inflation mechanisms 522*a* and 522*b*, without losing any volume in inflation chambers 536*a* and 536*b*, respectively, as compared with inflation mechanisms 322*a* and 322*b* of FIG. 3.

Inflation chambers 536*a* and 536*b* may include foam cores 546*a* and 546*b*, which assist in expanding the volume of inflation chambers 536*a*, 536*b*, respectively, when downward pressure of the wearer's foot is removed. While preferably, first interior layer 550 with holes 542 faces an interior of a shoe towards a wearer's foot, such as shoe 100, first interior layer 550, in the alternative, may face away from a wearer's foot with an exterior surface of the shoe upper 114 exterior to first interior layer 550, such that air is still circulated by ventilation system 110 inside the upper of the shoe. For example, the air may be directed around but not directly against the foot.

Third layer 554 also includes a deflation mechanism 520, which may be any of the deflation mechanisms discussed herein.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. An article of footwear, comprising:

a sole;

an upper attached to said sole, said upper having an inflatable bladder and a ventilation system formed between two sheets of thermoplastic material sealed together along a peripheral weld line, wherein said inflatable bladder and wherein said ventilation system are separately defined by interior weld lines and said ventilation system includes an interior passageway between the two sheets of thermoplastic material defined by the interior weld lines and a plurality of perforations in one of said two sheets of thermoplastic material; and an inflation mechanism fluidly connected to said ventilation system via an interior passageway defined by the interior weld lines such that fluid flows through the interior passageway and through said plurality of perforations into an interior of the article of footwear.

2. The article of footwear of claim 1, wherein said inflation mechanism is operated by the downward pressure of a wearer's foot.

3. The article of footwear of claim 1, wherein said inflation mechanism is fluidly connected to both said inflatable bladder and said ventilation system.

4. The article of footwear of claim 1, wherein a first inflation mechanism is fluidly connected to said inflatable bladder and a second inflation mechanism is fluidly connected to said ventilation system.

5. The article of footwear of claim 4, wherein said first inflation mechanism is in a heel portion of said article of footwear and said second inflation mechanism is in a forefoot portion of said article of footwear.

6. The article of footwear of claim 4, wherein both said first and second inflation mechanisms are disposed in a heel portion of said article of footwear.

7. The article of footwear of claim 6, wherein said first and second inflation mechanisms are disposed horizontally parallel to one another.

8. The article of footwear of claim 6, wherein said first and second inflation mechanisms are disposed vertically parallel to one another.

9. The article of footwear of claim 1, wherein said ventilation system and said inflatable bladder are monolithic.

10. The article of footwear of claim 9, wherein said fluid system and said inflation mechanism are monolithic.

11. The article of footwear of claim 1, wherein at least a portion of said fluid system structure forms an exterior surface of said article of footwear.

12. The article of footwear of claim 1, wherein said inflation mechanism includes a regulator valve.

13. The article of footwear of claim 1, wherein said inflation mechanism includes a pressure sensitive diverter valve.

14. An article of footwear, comprising:

a sole;

an upper attached to said sole, said upper having an inflatable bladder and a ventilation system formed from two sheets of thermoplastic material sealed together along a peripheral weld line, wherein said inflatable bladder and said ventilation system are separately defined by interior weld lines and wherein said ventilation system includes an interior passageway defined by the interior weld lines and a plurality of perforations in one of said two sheets of thermoplastic material;

an inflation mechanism operated by the downward pressure of a wearer's foot, wherein said inflation mechanism includes a fluid inlet and a first fluid outlet fluidly connected to said inflatable bladder with a first valve allowing fluid to flow from said inflation mechanism to said inflatable bladder and restricting fluid from flowing from said inflatable bladder to said inflation mechanism and a second fluid outlet fluidly connected to said ventilation mechanism with a second valve allowing fluid to flow from said inflation mechanism to said ventilation system and restricting fluid from flowing from said ventilation system to said inflation mechanism, wherein said first valve is actuated at a lower pressure than said second valve.

* * * * *